US005315768A

United States Patent [19]

Pacheco

[11] Patent Number: 5,315,768

[45] Date of Patent: May 31, 1994

[54] SHOE TRACTION ATTACHMENT

[76] Inventor: Durate S. Pacheco, 10 Second St., Portsmouth, R.I. 02871

[21] Appl. No.: 61,259

[22] Filed: May 17, 1993

[51] Int. Cl.[5] ..... A43B 3/16; A43B 3/18; A43B 15/00

[52] U.S. Cl. ..... 36/7.1 R; 36/134; 36/7.20; 36/7.70; 36/59 R; 36/62

[58] Field of Search ..... 36/7.1 R, 7.2, 7.3, 36/7.6, 7.7, 59 R, 59 D, 61, 62, 64, 65, 66, 67 D, 8.1, 124, 134

[56] References Cited

U.S. PATENT DOCUMENTS

| | | | |
|---|---|---|---|
| 591,888 | 10/1897 | Seay | 36/7.1 R |
| 1,227,981 | 5/1917 | Tynes | 36/8.1 |
| 1,230,118 | 6/1917 | Clifford | 36/66 |
| 2,171,654 | 9/1939 | Hinchliff et al. | 36/7.2 |
| 3,461,575 | 8/1969 | Tead et al. | 36/8.1 |
| 3,520,075 | 7/1970 | Mullikin | 36/65 |
| 4,446,635 | 5/1984 | Hayden | 36/7.6 |
| 4,693,019 | 9/1987 | Kim | 36/7.1 R |
| 4,779,360 | 10/1988 | Bible | 36/59 R |

*Primary Examiner*—Paul T. Sewell
*Assistant Examiner*—Marie Denise Patterson
*Attorney, Agent, or Firm*—E. Michael Combs

[57] ABSTRACT

An elastomeric mesh bag member is arranged for receiving a shoe therewithin to provide for covering of the shoe sole and optionally of the shoe heel. For use with elevated heel construction, the bag member includes a heel opening to receive the heel therethrough. The elastomeric strands of the bag member may employ a matrix of tooth members to extend over the shoe heel and sole portion for enhanced traction, as well as using an optionally employable traction disc securable to the strands adjacent the toe portion of the associated shoe.

2 Claims, 5 Drawing Sheets

FIG. 3
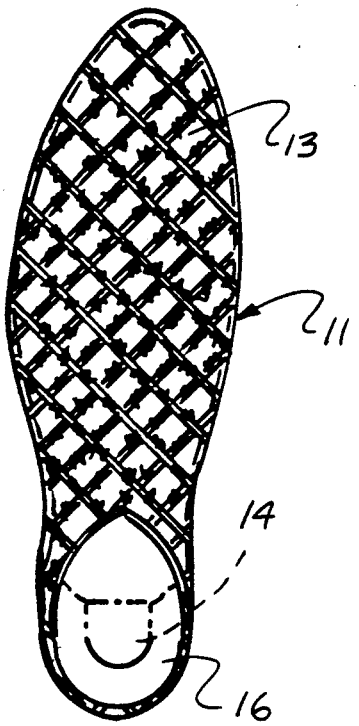
FIG. 4
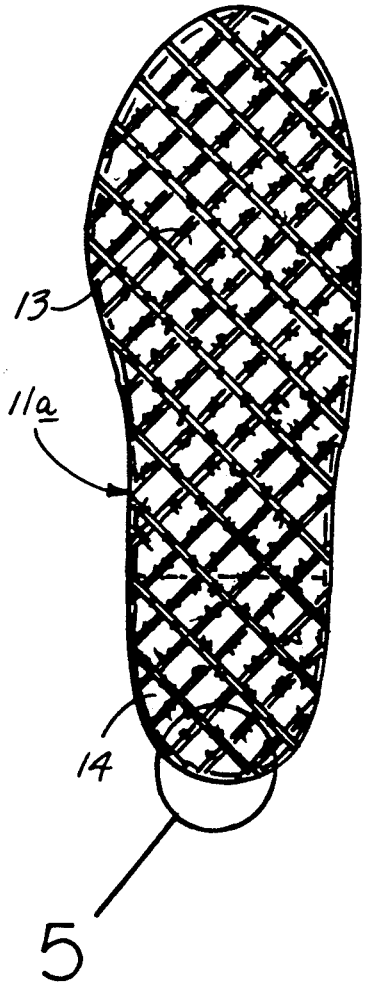
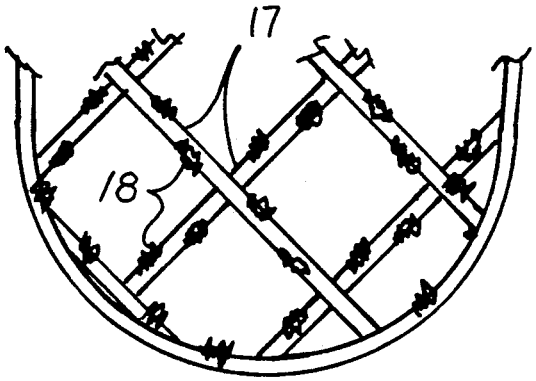
FIG. 5

SHOE TRACTION ATTACHMENT

BACKGROUND OF THE INVENTION

1. Field of the Invention

The field of invention relates to shoe traction structure, and more particularly pertains to a new and improved shoe traction attachment arranged for receiving a shoe member therewithin for enhanced traction to the shoe during use.

2. Description of the Prior Art

Shoe traction structure is available in the prior art and exemplified by the U.S. Pat. Nos. 3,889,401; 4,302,890; 4,434,565; and 4,897,935.

The instant invention attempts to overcome deficiencies of the prior art in affording the ease of a bag member arranged to secure a shoe in a non-slip arrangement between the bag member and the shoe and to afford enhanced traction to the shoe during wearing of the shoe and in this respect, the present invention substantially fulfills this need.

SUMMARY OF THE INVENTION

In view of the foregoing disadvantages inherent in the known types of shoe traction structure now present in the prior art, the present invention provides a shoe traction attachment wherein the same is arranged as an elastomeric mesh bag member arranged to receive a shoe therewithin for providing enhanced traction to the shoe during use. As such, the general purpose of the present invention, which will be described subsequently in greater detail, is to provide a new and improved shoe traction attachment which has all the advantages of the prior art shoe traction apparatus and none of the disadvantages.

To attain this, the present invention provides an elastomeric mesh bag member arranged for receiving a shoe therewithin to provide for covering of the shoe sole and optionally of the shoe heel. For use with elevated heel construction, the bag member includes a heel opening to receive the heel therethrough. The elastomeric strands of the bag member may employ a matrix of tooth members to extend over the shoe heel and sole portion for enhanced traction, as well as using an optionally employable traction disc securable to the strands adjacent the toe portion of the associated shoe.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shoe traction attachment which has all the advantages of the prior art shoe traction apparatus and none of the disadvantages.

It is another object of the present invention to provide a new and improved shoe traction attachment which may be easily and efficiently manufactured and marketed.

It is a further object of the present invention to provide a new and improved shoe traction attachment which is of a durable and reliable construction.

An even further object of the present invention is to provide a new and improved shoe traction attachment which is susceptible of a low cost of manufacture with regard to both materials and labor, and which accordingly is then susceptible of low prices of sale to the consuming public, thereby making such shoe traction attachments economically available to the buying public.

Still yet another object of the present invention is to provide a new and improved shoe traction attachment which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, taken along the lines 3—3 of FIG. 1 in the direction indicated by the arrows.

FIG. 4 is an orthographic view, taken along the lines 4—4 of FIG. 2 in the direction indicated by the arrows.

FIG. 5 is an enlarged orthographic view of section 5 as set forth in FIG. 4.

DESCRIPTION OF THE PREFERRED EMBODIMENT

Figure 1:
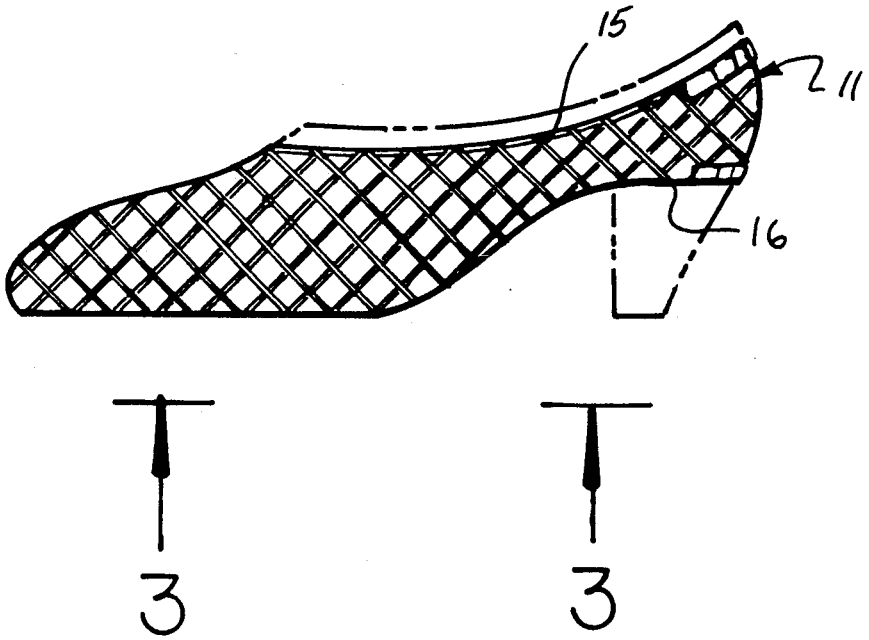
FIG. 1 is an orthographic side view of the invention mounted to a shoe with an elevated heel portion.
Figure 2:
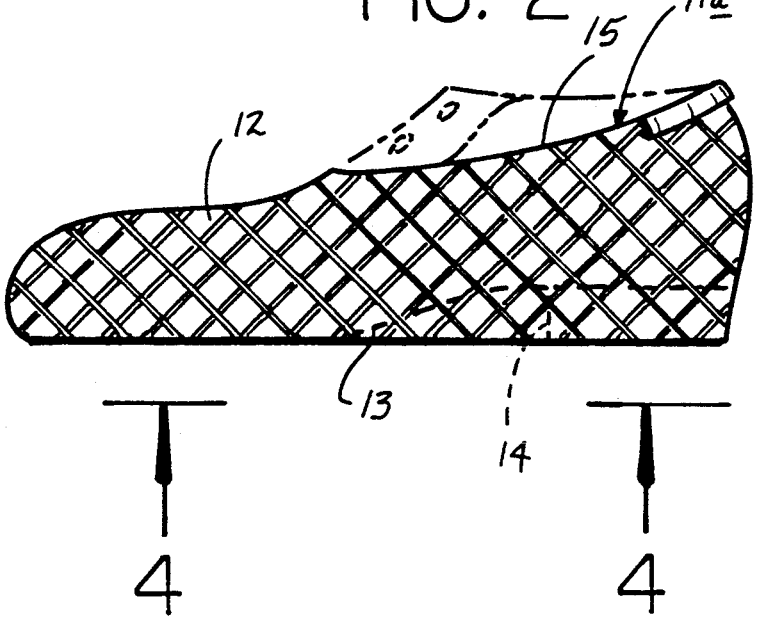
FIG. 2 is an orthographic side view of the invention mounted to a shoe with a bag member extending over the heel portion of the shoe.

With reference now to the drawings, and in particular to FIGS. 1 to 11 thereof, a new and improved shoe traction attachment embodying the principles and concepts of the present invention and generally designated by the reference numerals 11-27 will be described.

More specifically, the shoe traction attachment of the invention essentially comprises an elastomeric mesh bag member 11 formed of individual elastomeric stands 17. The bag member 11 is arranged for receiving a shoe member, having a shoe upper 12, a shoe sole 13, and a shoe heel 14. In the configuration of FIG. 1, the shoe heel is of a "high heel" construction, wherein the bag member 11 is formed with a heel opening 16 (see FIG. 3) to receive the heel therethrough. The heel opening 16 is arranged in addition to the bag member entrance opening 15 that receives the shoe within the bag member. The elastomeric strands 17 define a matrix of openings between the intersecting strands 17 such that the elastomeric strands 17 provide for enhanced traction with the strands positioned relative to and in contiguous communication to the shoe sole 13 and the shoe heel 14.

The FIGS. 3-5 indicate the further use of rigid toothed members 18 embedded along at spaced intervals to the elastomeric strands 17 to enhance traction if desired.

Figure 6:
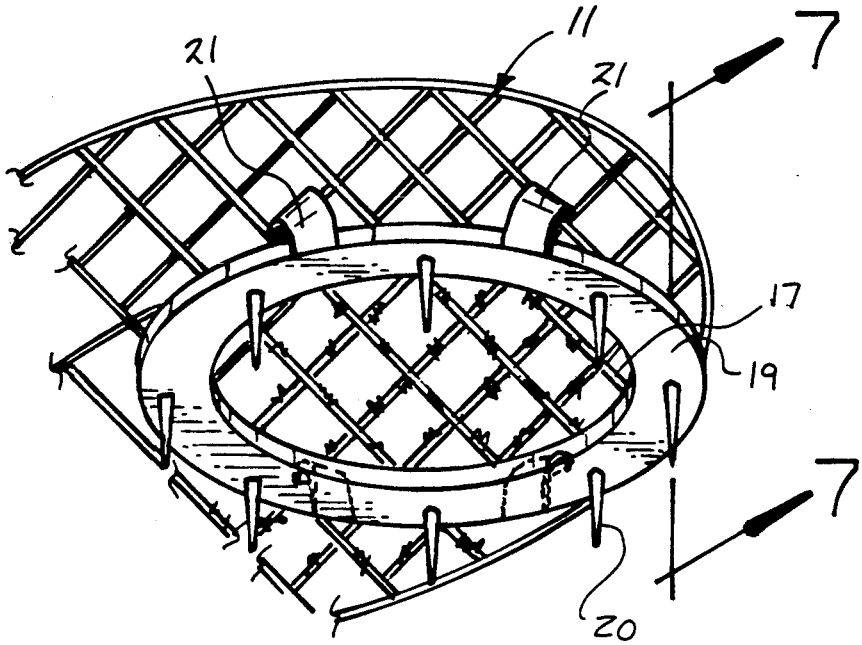
FIG. 6 is an isometric illustration of a traction disc arranged for optional mounting to the bag member.
Figure 7:
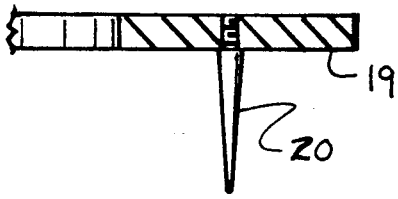
FIG. 7 is an orthographic view, taken along the lines 7—7 of FIG. 6 in the direction indicated by the arrows.

The FIG. 6 indicates the use of a traction annular disc 19, having disc spikes 20 threadedly received within the discs in an orthogonal relationship, with spikes 20 of a first length. The disc 19 is formed with disc bendable tabs 21 mounted about the periphery of the disc for securing a plurality of elastomeric stands 17 for positioning the disc in adjacency to the toe portion of the bag member 11 relative to the associated shoe.

Figure 8:
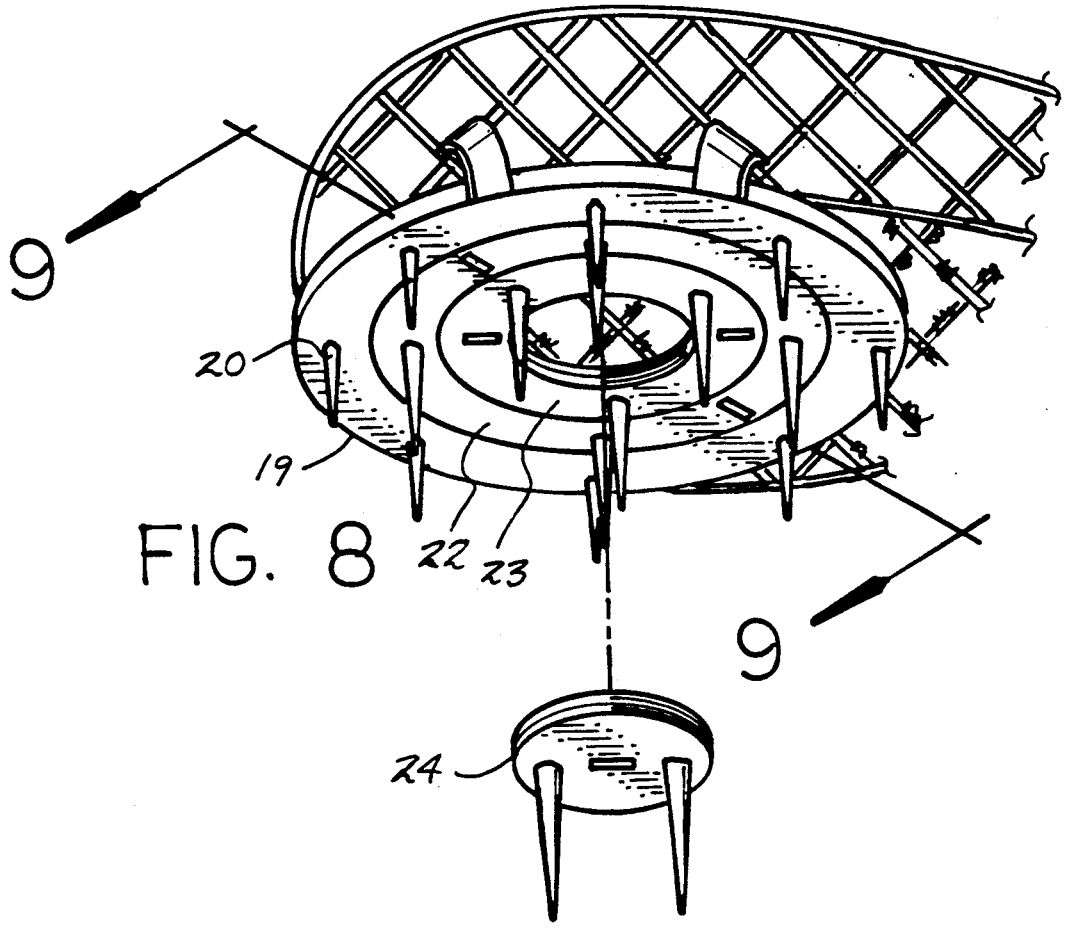
FIG. 8 is an isometric illustration of the disc member employing interior discs therewithin.
Figure 9:
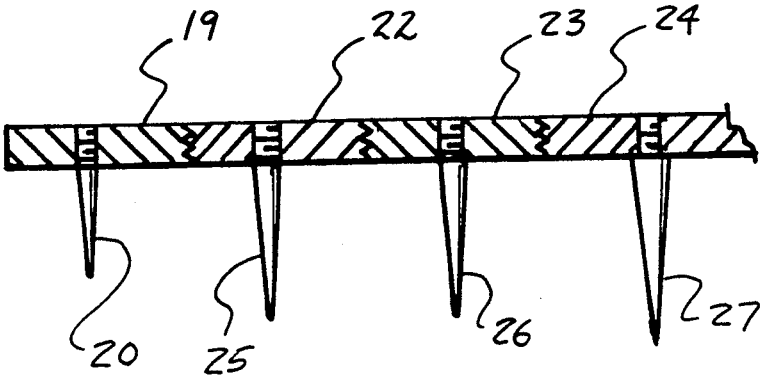
FIG. 9 is an orthographic view, taken along the lines 9—9 of FIG. 8 in the direction indicated by the arrows.

The FIGS. 8 and 9 indicate the further use of a respective first, second, and third inner disc 22, 23, and 24 respectively that are threadedly received relative to one another, with the first, second, and third discs 22, 23, and 24 having respective first, second, and third inner disc spikes 25, 26, and 27 respectively. The first spikes 25 are of a second length greater than the first length of the disc spikes 20, with the second spikes 26 of a third length greater than the second length of the first inner spikes 22. The third inner discs 24 have third inner spikes 27 of a fourth length greater than the third length. In this manner, individuals employ the inner discs selectively to provide for selective enhance traction as desired and necessary and thus tailored by an individual to surrounding ground conditions.

Figure 10:
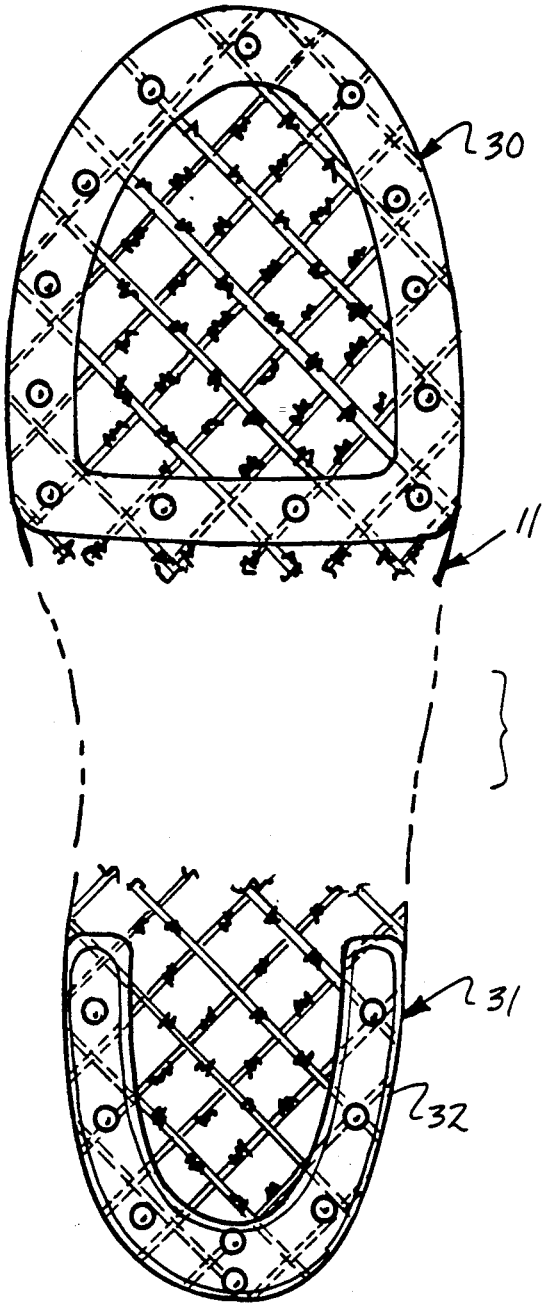
FIG. 10 is an orthographic side view of a sole and heel portion mounted to the shoe member.
Figure 11:
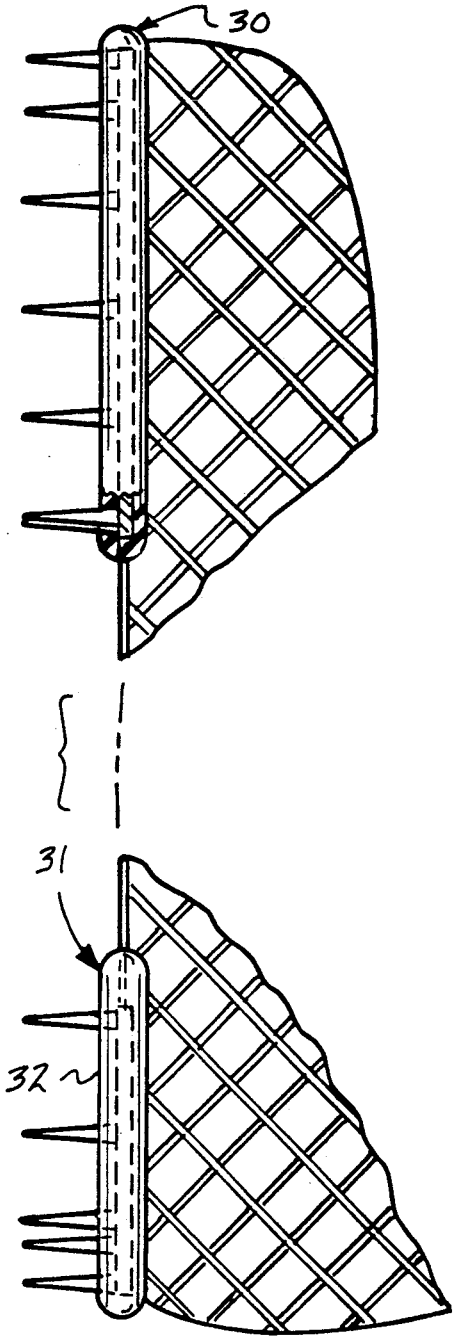
FIG. 11 is an orthographic side view of the sole and heel portion as mounted to the shoe bag member.

The FIGS. 10 and 11 indicates the use of the optional traction devices having a sole portion 30 and a heel portion 31, the heel portion 31 having a continuous elastomeric traction rib mounted coextensively about the periphery of the heel portion 31. Spike members may be imbedded within associated plate structure, as indicated in FIG. 11, within the respective sole and heel portions. The plate may be pre-threaded to threadedly receive various spike members, in a manner as indicated in the FIG. 9 for example, in lieu of integral mounting of the spike members to the respective sole and heel portions 30 and 31. Central portions of the bag member within the respective sole and heel portions must be free to engage and subsequently dislodge snow received therewithin for enhanced gripping in wintry climatic conditions. Further, the traction devices, as indicated, are further arranged to be received within the bag member and in this manner not require additional mounting structure such as the tab structure as indicated in FIG. 8.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shoe traction attachment arranged in combination with a shoe member, wherein the shoe member includes a shoe upper, with a shoe sole and a shoe heel, and an elastomeric mesh bag member having intersecting elastomeric strands defining openings between the strands, with the bag member having a bag member entrance opening to receive the shoe therewithin, with the bag member including first strand portions in contiguous communication to the sole and second strand portions arranged in adjacency to the heel, and a heel opening directed through the bag member to direct the shoe heel therethrough, and the first elastomeric strands and the second elastomeric strands include a plurality of spaced rigid tooth members imbedded therewithin for enhanced traction, and a traction annular disc, wherein the annular disc includes a disc periphery, and the disc periphery includes a plurality of bendable tabs, wherein the bendable tabs are located about the periphery of said disc such that when bent, said tabs receive a plurality of the first elastomeric strands therethrough in adjacency to a toe portion of the shoe, with the disc having a plurality of disc spikes orthogonally and threadedly received within the disc, with the disc spikes of a first length.

2. A shoe traction attachment as set forth in claim 1 including a first inner disc threadedly received within the annular disc, a second inner disc threadedly received within the first inner disc, and a third inner disc threadedly received within the second inner disc, wherein the annular disc, the first inner disc, the second inner disc, and the third inner disc are arranged in a coplanar relationship, and the first inner disc includes a plurality of first inner disc spikes having a second length greater than the first length, the second inner disc including a plurality of second inner disc spikes having a third length greater than the second length, and a third inner disc having a plurality of third inner disc spikes having a fourth length greater than the third length.

* * * * *